US009731941B2

(12) United States Patent
Lee et al.

(10) Patent No.: US 9,731,941 B2
(45) Date of Patent: Aug. 15, 2017

(54) BRAKING DEVICE FOR A DOOR OPERATOR

(75) Inventors: Jinkoo Lee, Anyang-si (KR); Jung Sam Kim, Seoul (KR); Byeong Sam Yoo, Anyang (KR); Hansoo Shim, Seoul (KR); Guohong Hu, Farmington, CT (US); Mark Steven Thompson, Tolland, CT (US)

(73) Assignee: Otis Elevator Company, Farmington, CT (US)

( * ) Notice: Subject to any disclaimer, the term of this patent is extended or adjusted under 35 U.S.C. 154(b) by 959 days.

(21) Appl. No.: 13/697,046

(22) PCT Filed: Nov. 30, 2010

(86) PCT No.: PCT/US2010/058358
§ 371 (c)(1),
(2), (4) Date: Nov. 9, 2012

(87) PCT Pub. No.: WO2011/142780
PCT Pub. Date: Nov. 17, 2011

(65) Prior Publication Data

US 2013/0056306 A1 Mar. 7, 2013

(30) Foreign Application Priority Data

May 11, 2010 (KR) ..... 10-2010-0043817

(51) Int. Cl.
*B66B 13/24* (2006.01)
*E05F 5/02* (2006.01)
(Continued)

(52) U.S. Cl.
CPC ..... *B66B 13/24* (2013.01); *E05F 5/003* (2013.01); *E05F 15/632* (2015.01); *B66B 13/06* (2013.01)

(58) Field of Classification Search
CPC ..... E05F 5/06; E05F 5/12; E05F 15/44; E05F 15/40; E05F 5/003; E05F 15/632; B66B 13/06; B66B 13/08; B66B 13/26
(Continued)

(56) References Cited

U.S. PATENT DOCUMENTS 3,638,762 A 2/1972 Johns
3,691,688 A * 9/1972 Kaiserswerth ..... 49/394
(Continued)

FOREIGN PATENT DOCUMENTS

EP 1396461 A1 3/2004
JP 49-26950 3/1974
(Continued)

OTHER PUBLICATIONS

International Search Report and Written Opinion of the International Searching Authority for International application No. PCT/US2010/058358 dated Aug. 9, 2011.
(Continued)

*Primary Examiner* — William A Rivera
*Assistant Examiner* — Stefan Kruer
(74) *Attorney, Agent, or Firm* — Carlson, Gaskey & Olds

(57) ABSTRACT

A device for inhibiting the closing of a door that controls entry of an enclosure includes a first magnet disposed on a driven portion of the device and a second magnet disposed on a fixed portion of the enclosure. The first magnet and the second magnet are configured to be in register with each other as the door moves toward a closed position such that if the first magnet and the second magnet are in register with each other, a pole of the first magnet is in close proximity of a pole of the second magnet such that the first magnet and the second magnet react to each other to inhibit motion of the door towards the closed position.

8 Claims, 10 Drawing Sheets

(51) Int. Cl.
*E05F 15/632* (2015.01)
*E05F 5/00* (2017.01)
*B66B 13/06* (2006.01)

(58) Field of Classification Search
USPC ..... 49/28, 118, 123; 310/12.25; 187/252, 187/318, 324, 328, 329
See application file for complete search history.

(56) References Cited

U.S. PATENT DOCUMENTS

| | | | | |
|---|---|---|---|---|
| 3,791,687 | A | 2/1974 | Schroeder | |
| 4,009,767 | A | 3/1977 | Stadigh | |
| 4,735,292 | A * | 4/1988 | Munz | 187/324 |
| 5,134,324 | A * | 7/1992 | Sakagami et al. | 310/12.04 |
| 5,172,518 | A * | 12/1992 | Yoshino | 49/360 |
| 5,196,656 | A | 3/1993 | Mizuno et al. | |
| 5,819,878 | A * | 10/1998 | Barrett et al. | 187/324 |
| 5,852,897 | A * | 12/1998 | Sukale | 49/358 |
| 5,880,414 | A | 3/1999 | Jaminet et al. | |
| 5,942,867 | A * | 8/1999 | Richmond | 318/280 |
| 6,055,777 | A * | 5/2000 | Rekioja | 49/360 |
| 6,164,417 | A | 12/2000 | Oberleitner | |
| 6,467,584 | B2 | 10/2002 | Yamamoto et al. | |
| 6,543,581 | B1 * | 4/2003 | Durand et al. | 187/316 |
| 6,588,811 | B1 * | 7/2003 | Ferguson | 292/251.5 |
| 2002/0089237 | A1 * | 7/2002 | Hazelton | 310/12 |
| 2007/0295564 | A1 | 12/2007 | Someya | |
| 2008/0271959 | A1 | 11/2008 | Gieras et al. | |

FOREIGN PATENT DOCUMENTS

| | | | | |
|---|---|---|---|---|
| JP | 2000095463 | A * | 4/2000 | B66B 13/08 |
| JP | 2009256045 | A | 11/2009 | |
| KR | 2000-0013168 | | 3/2000 | |
| KR | 100295904 | | 5/2001 | |
| KR | 20110120570 | A * | 11/2011 | G09G 3/3208 |
| KR | 20110124451 | A * | 11/2011 | B66B 13/24 |
| KR | 101423215 | B1 * | 7/2014 | B66B 13/08 |
| WO | 02100753 | | 12/2002 | |
| WO | WO 03029124 | A1 * | 4/2003 | B66B 13/08 |

OTHER PUBLICATIONS

First Search Report by the State Intellectual Property Office of People's Republic China for Chinese Application No. 201080066688.3 dated Jan. 7, 2014.
International Preliminary Report on Patentability for International application No. PCT/US2010/058358 dated Nov. 22, 2012.

* cited by examiner

BRAKING DEVICE FOR A DOOR OPERATOR

CROSS-REFERENCE TO RELATED APPLICATION

This application is the national phase application of PCT/US10/58358, which was filed on Nov. 30, 2010, and which claims priority to Korean Patent Application No. 10-2010-0043817, which was filed on May 11, 2010, which is hereby incorporated by reference in its entirety.

BACKGROUND

Elevator doors are suspended by hangers that have wheels that ride in or along a track on a lintel attached to an elevator car. The doors are powered open and closed by means of a reversible electric motor that drives a cable attached to the hanger of each door.

An elevator car door opening and closing apparatus of a prior art elevator car 301 is shown in FIG. 11. At one end of a car door header 303, a motor 304 is fixedly installed, and at another end, a driven pulley 309 is installed with a fixed gap. A driving belt 310, with an endless loop, is wound between the motor 304 and the driven pulley 309. At the car door header 303, a car door rail 311 is installed in the longitudinal direction of the door opening 302. Two car doors 312 are respectively hung on the car door rail 311 through car door hangers 313. Each car door hanger 313 has several rollers 314 that make a smooth circular motion along the car door rail 311. The car doors 312 are connected to the driving belt 310 through brackets 315 and 316 attached to the car door hangers 313. In the prior art with this constitution, while the car doors 312 move along the car door rail 311, the car doors 312 are opened and closed through the rotation of the driving belt 310 by the power of the motor 304.

If power is lost, it is desirable for doors to remain in their current position, even if fully or partially open. In fact, some elevator and/or fire codes require that during a power interruption, automatic power operated doors do not move until power is restored and a door open or a closed button is pressed. Contrary to this desire, oftentimes car doors will drift closed at the landing zone due to closing force, from the landing side doors, that overcomes system friction, such as, for example, as a result of closing weights that are typically used to facilitate door closing during normal operation.

SUMMARY

According to an exemplar provided herein, a device for inhibiting the closing of a door that controls entry of an enclosure includes a first magnet disposed on a driven portion of the device, and a second magnet disposed on a fixed portion of the enclosure. The first magnet and the second magnet are configured to be in register with each other as the door moves toward a closed position such that if the first magnet and the second magnet are in register with each other, a pole of the first magnet is in close proximity of a pole of the second magnet such that the first magnet and the second magnet react to each other to inhibit motion of the door towards the closed position.

According to a further exemplar provided herein, a device for inhibiting the closing of an elevator car door that controls entry of an elevator car includes a powered mechanism for closing the door, a first magnet disposed on a driven portion of the door, and a second magnet disposed on a portion of the car. The first magnet and the second magnet are configured to be in register with each other as the door moves toward a closed position such that if the first magnet and the second magnet are in register with each other, a pole of the first magnet is in close proximity of a pole of the second magnet such that the first magnet and the second magnet react to each other to inhibit motion of the door towards the closed position.

According to a still further exemplar provided herein, a method of inhibiting closure of a powered door if power to the door is lost includes the steps of providing a first magnet disposed on the door, providing a second magnet disposed on an enclosure adjacent to the door such that the first magnet and the second magnet are in register with each other along a length of travel of the door, and reacting the first magnet and the second magnet to retard motion of the door towards a closed position.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are hereafter briefly described.

DETAILED DESCRIPTION

Figure 1:
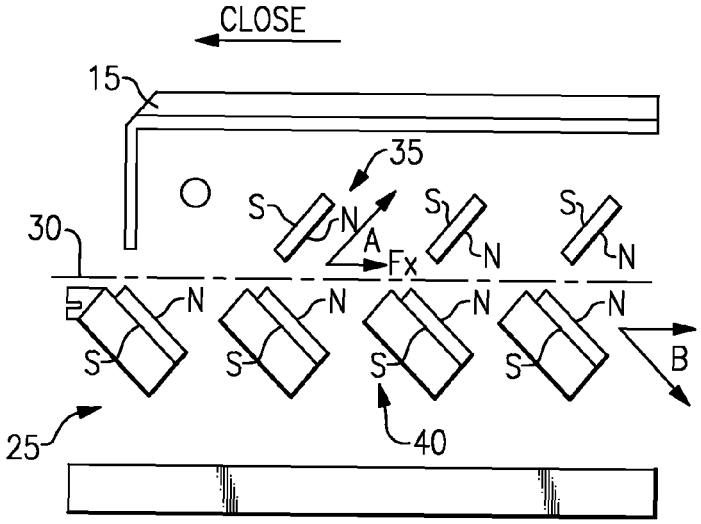
FIG. 1 is a schematic view of a first embodiment of magnets disposed in an elevator system.

Efforts have been made throughout the drawings to use the same or similar reference numerals for the same or like components.

Referring now to FIG. 1, an elevator car 10 (see FIG. 2) includes a stationary lintel 25 and a movable door 12. The door 12 includes a hanger 15 and a door panel 20 (see FIG. 2 etc.) that depends from the hanger 15. The hanger 15 and the lintel 25 are separated by an axis 30. Essentially, the hanger 15 could be any part that moves relative to the elevator car and moves with or causes movement of the car door panel 20. The lintel 25, similarly, is any part of the elevator car 10 that is stationary relative to any part that moves relative to the elevator car 10 and moves with or causes movement of the car door 12. The hanger 15 may depend from the lintel 25 by way of one or more wheels 75. More specifically, the wheels 75 of the hanger 15 may be received, and roll within or on, a track or rail 80 formed on the lintel 25. In other embodiments, the hanger 15 may have a shoe that is configured to slide on or in a corresponding rail of the lintel 25. Regardless, the lintel 25 and the hanger 15 may be registered with each other in a variety of ways to affect the concepts demonstrated herein.

According to a first embodiment disclosed herein, the hanger 15 has a first array of magnets 35 disposed at a first angle A relative to the axis 30 mounted thereon. The lintel 25 has a second array of magnets 40 disposed at a second angle B relative to the axis 30. As shown herein, angle A is approximately 45 degrees and angle B is approximately 45 degrees so that the sum of angle A and angle B, and the relationship between each of the first array of magnets 35 and each of the second array of magnets 40, is approximately 90 degrees. Though angle A and angle B are shown to be about 90 degrees in sum, other angles for the first array of magnets and the second array of magnets are contemplated herein. Moreover, it is also contemplated herein that the overall angle between the first array and the second array of magnets may differ along a length of each array depending on where the door panel 20 is relative to the lintel as the door 12 closes. For instance, if the door panel 20 is closer to fully closed and power is lost, the overall angle between the magnets in the first array of magnets 35 and the magnets in the second array of magnets 40 may vary.

Each magnet of the first array of magnets 35 and the second array of magnets 40 may be a permanent magnet. If a separate power source (not shown) for the two arrays is available, electromagnets may be used.

The first array of magnets 35 and the second array of magnets 40 have their poles arranged so that they are in close proximity to the other of the similar arrangement. In other words, the south pole (or the north pole) of each of the first array of magnets 35 and the second array of magnets 40 are arranged closest to the axis 30. Similar poles form the apex of the angles A and B. By aligning similar poles closest to the axis 30, the first array of magnets 35 and the second array of magnets 40 repulse each other in a direction counter to CLOSE (see FIG. 1) to prevent (or at least inhibit) the hanger 15 (and thus the door panel 20) from drifting toward the closed position after power is lost in the elevator system.

Figure 2:
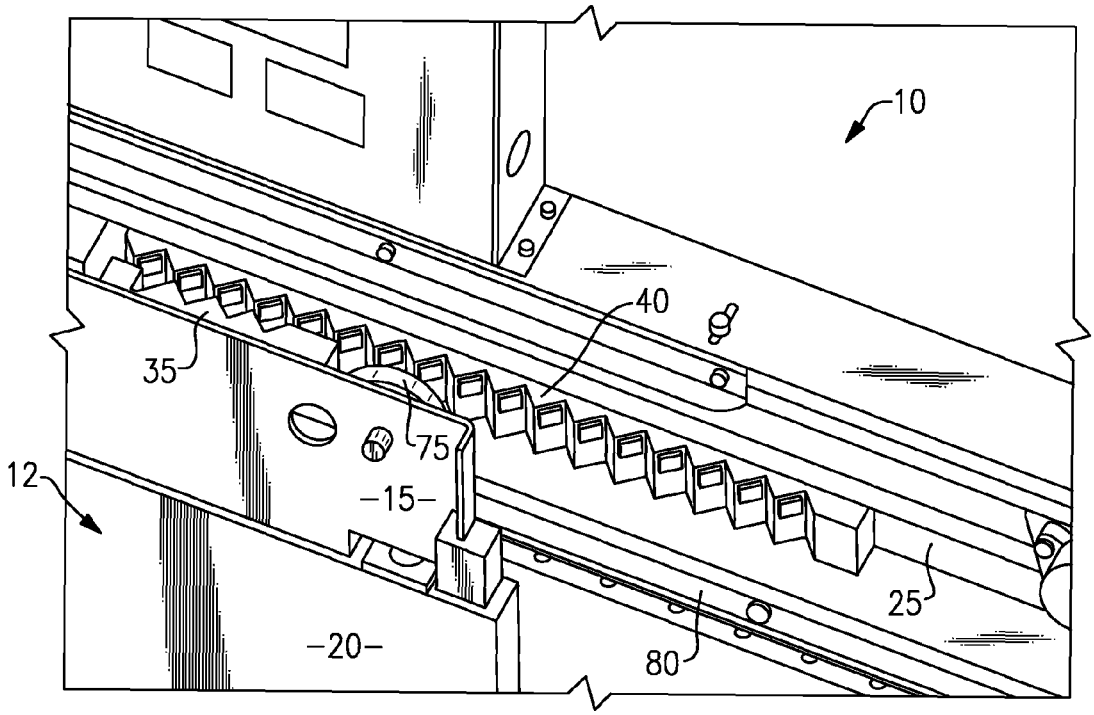
FIG. 2 is a first embodiment of an array of magnets in an elevator system as disclosed in FIG. 1.
Figure 3:
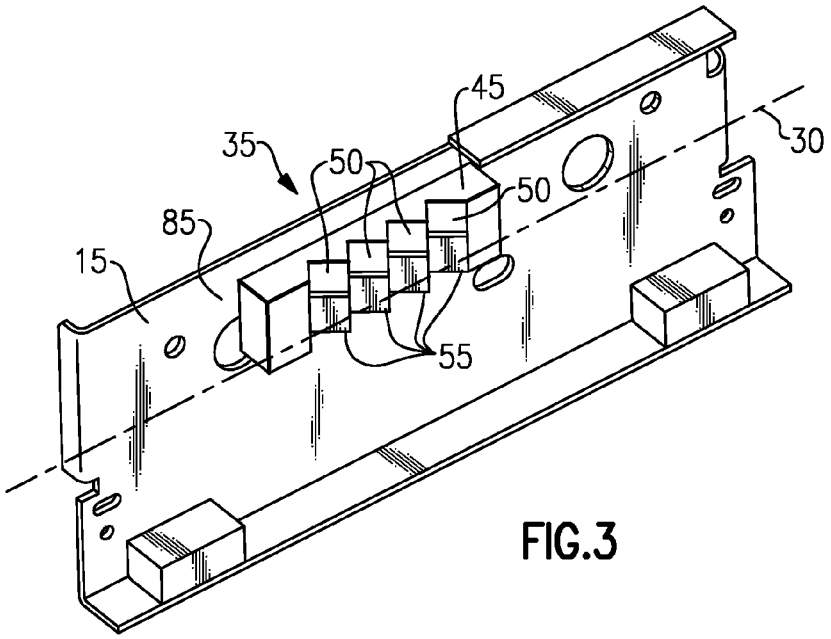
FIG. 3 is a perspective view of a hanger of FIG. 2 having a first array of magnets.
Figure 4:
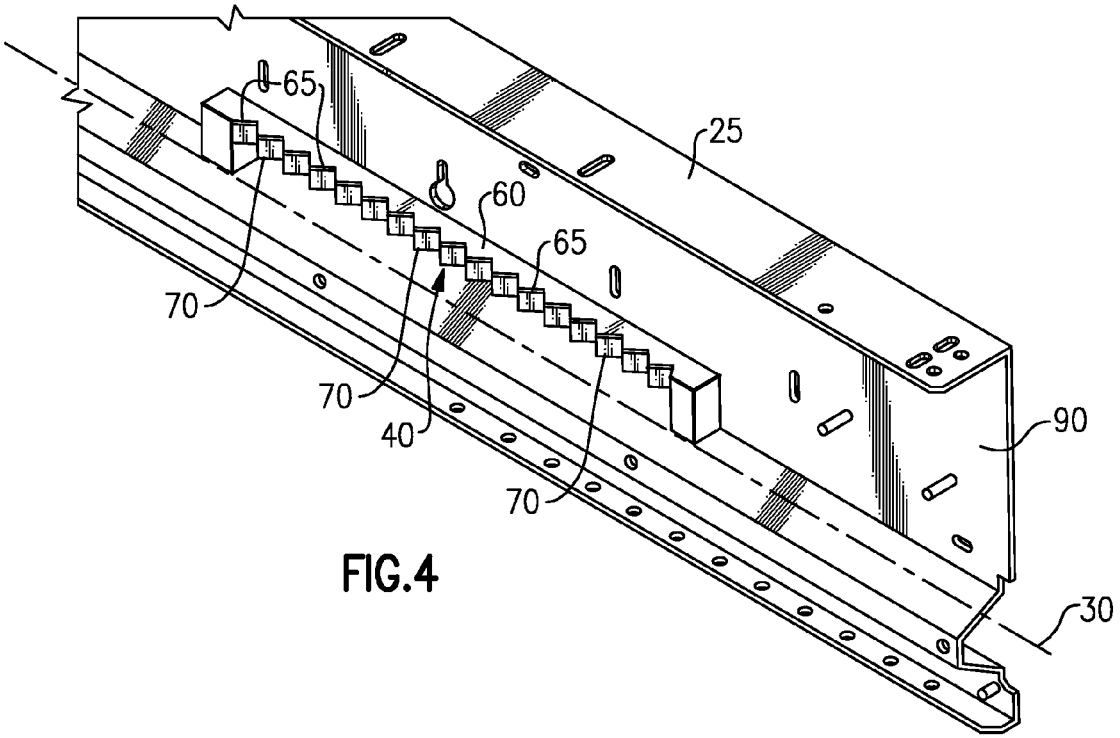
FIG. 4 is a depiction of a lintel of FIG. 2 having a second array of magnets.
Figure 5:
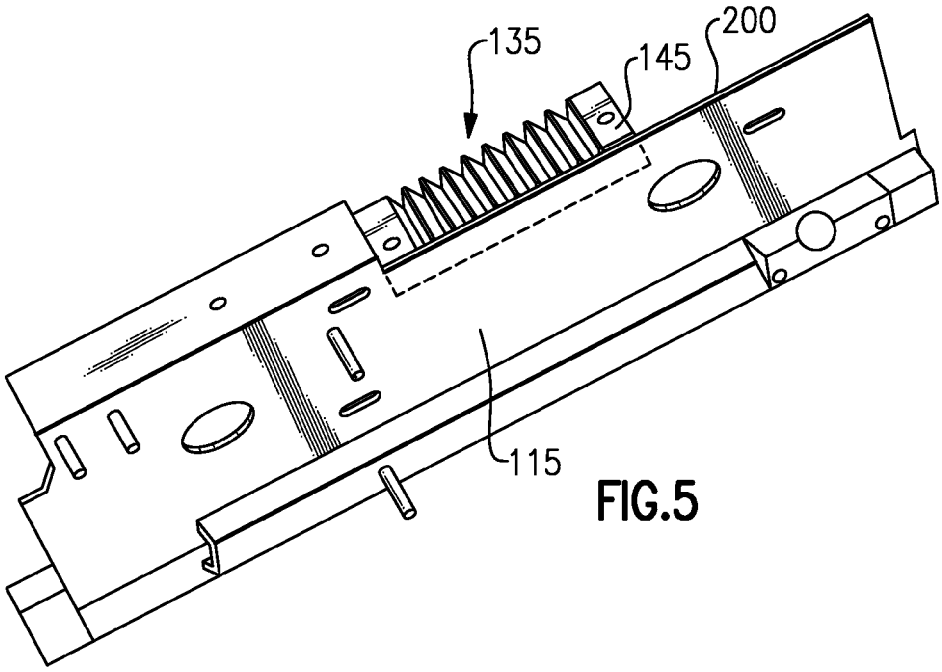
FIG. 5 is a second embodiment of a position of an array of magnets disposed on a hanger.

Referring now to FIGS. 2-4, the arrangement of the first array of magnets 35 and the second array of magnets 40 is shown. The first array of magnets 35 is arranged on a first holder 45 having a plurality of faces 50 upon which a magnet 55 is conventionally mounted. As stated hereinabove, each of the magnets 55 has same pole arranged towards the axis 30. Similarly, the second array of magnets 40 is arranged on a second holder 60 having a plurality of faces 65 upon which a magnet 70 is conventionally mounted. As stated hereinabove, each of the magnets 70 has a same pole arranged towards the axis 30 as the magnets 55. The faces 50 of magnets 55 are angled to provide the angle A and the faces 65 of magnets 70 are angled to provide the angle B respectively. Each of the magnets 55 in the first array of magnets 35 is attached to a corresponding face 50 by gluing or the like and each of the magnets 70 in the second array of magnets 40 is similarly attached to a corresponding face 65 by gluing or the like. The first holder 45 is attached to a vertical portion 85 of the hanger 15 in register with the second holder 60 that is attached to a vertical portion 90 of the lintel 25. In FIG. 2, the elevator door is partially opened.

The second holder 60 is longer than the first holder 45 to account for the length of travel of the door panel 20. As the door moves towards the closed position, the first holder 45 registers with the second holder 60 such that magnets 55 and 70 are in register throughout the length of travel as long as the door is partially open. If the door is not open, the magnets 55 and 70 may not be in register with one another as the first holder 45 is in register with a longitudinal portion (e.g., see 195 in FIG. 9 on the second holder 160) that has no magnets. If the magnets 55 of the first array of magnets 35 and the magnets 70 of the second array of magnets 40 are in register, they provide repulsive force to inhibit the door panel 20 from moving toward the closed position. The second holder 60 on the lintel 25, extends for a length of travel of the door panel 20 to ensure registration of the first array of magnets 35 and the second array of magnets 40 so that the door panel 20 may be held at its then-current (e.g., open) position if power is lost. The first holder 45 and the second holder 60 in this embodiment are disposed in a horizontal plane.

Though the first holder 45 is shown holding four magnets 55, other numbers of magnets may be held by the first holder. Similarly, other numbers of magnets 70 may be held on the second holder 60.

Figure 6:
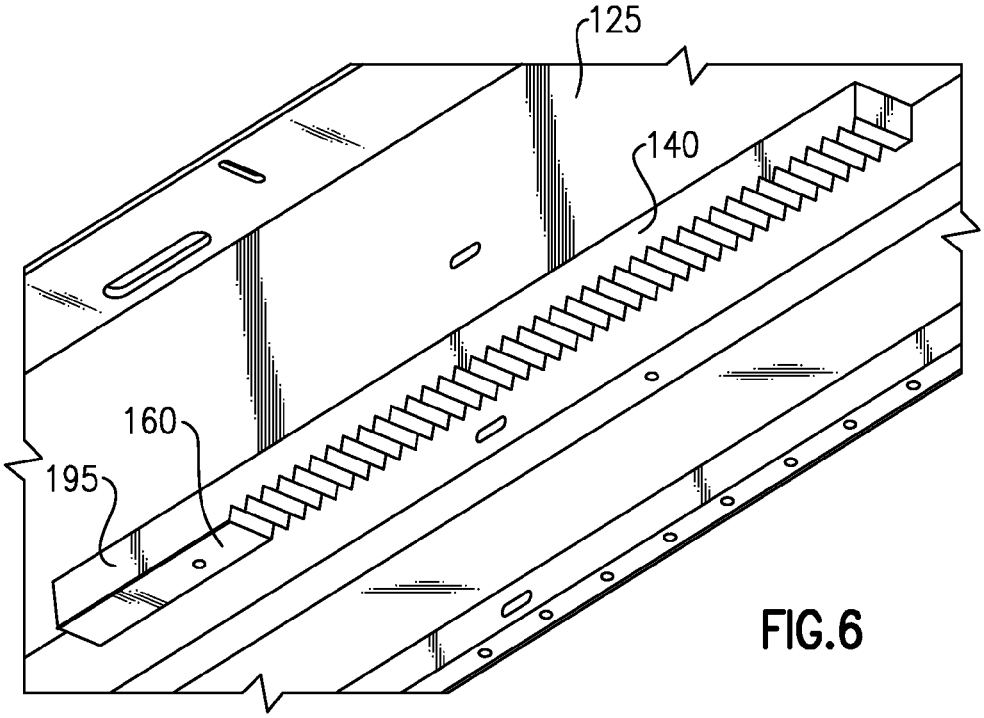
FIG. 6 is a depiction of a lintel of FIG. 7.
Figure 7:
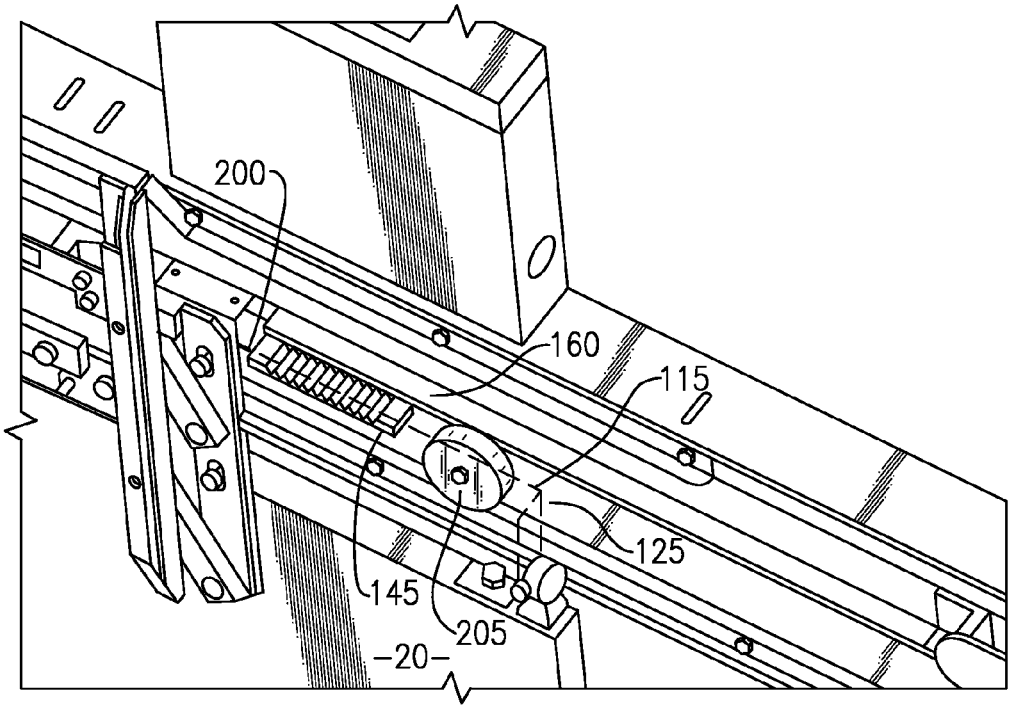
FIG. 7 is an assembled view of the hanger (shown in phantom lines) and lintel of FIGS. 5 and 6.
Figure 8:
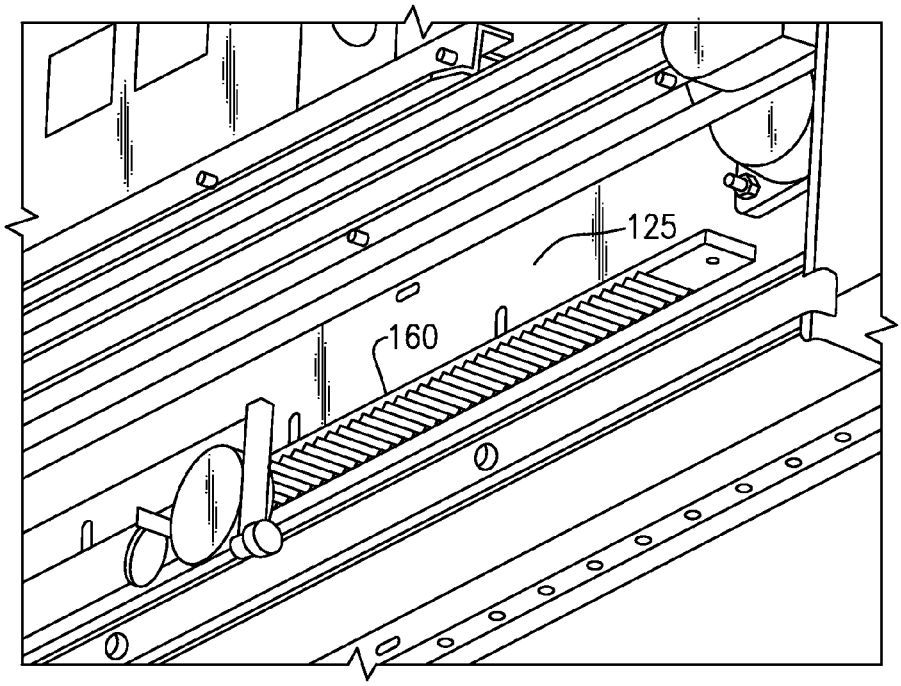
FIG. 8 is a perspective view of the elevator system of FIG. 7.

Referring now to FIGS. 5-8, another exemplar embodiment is shown. A third holder 145 holding a third array of magnets 135 is disposed adjacent an upper edge 200 of the hanger 115. Referring to FIG. 6, a fourth holder 160 of a fourth array of magnets 140 on a lintel 125 are disposed above the third holder 145 on the hanger 115 and in registration therewith. The third holder 145 and the fourth holder 160 are in vertical plane and registration with each other (see FIG. 10) about an axis 30A. The fourth holder 160 is arranged on the lintel 125 inwardly of hanger wheels 205 from which the hanger 115 depends. The downwardly facing fourth array of magnets 140 of the fourth holder 160 are configured to be in register with the upwardly facing third array of magnets 135 of the third holder 145.

Figure 9:
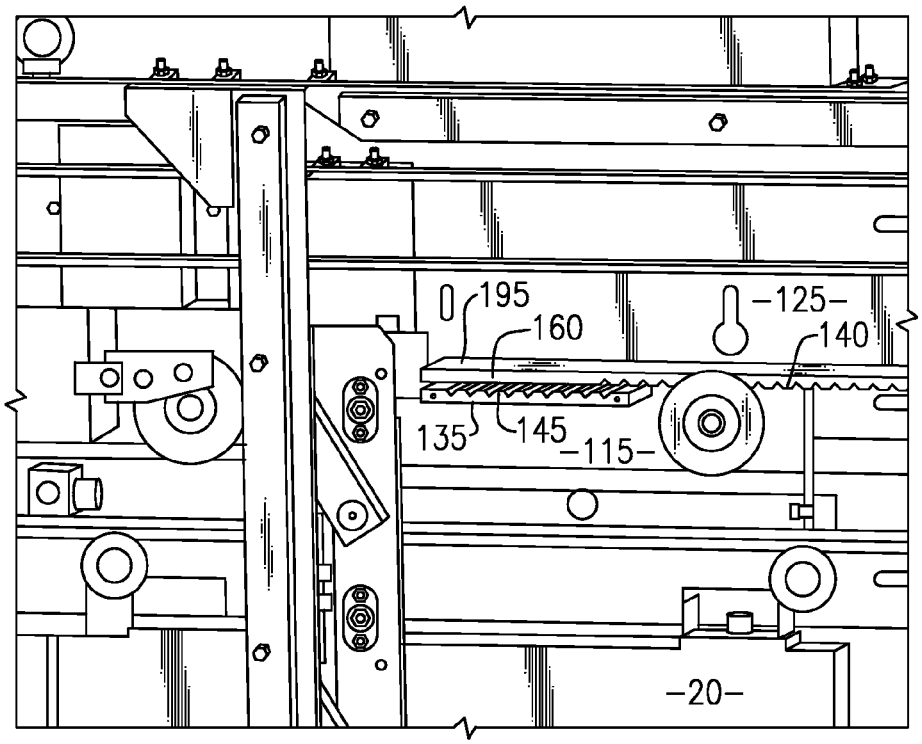
FIG. 9 is a depiction of the hanger and lintel of FIG. 7 in a fully closed position.

Referring now to FIG. 9, the door panel 20 is shown fully closed. The third array of magnets 135 held on the third holder 145 and the fourth array of magnets 140 held on the fourth holder 160 are not in register. As such, there is no repulsive force holding the door open.

Figure 10:
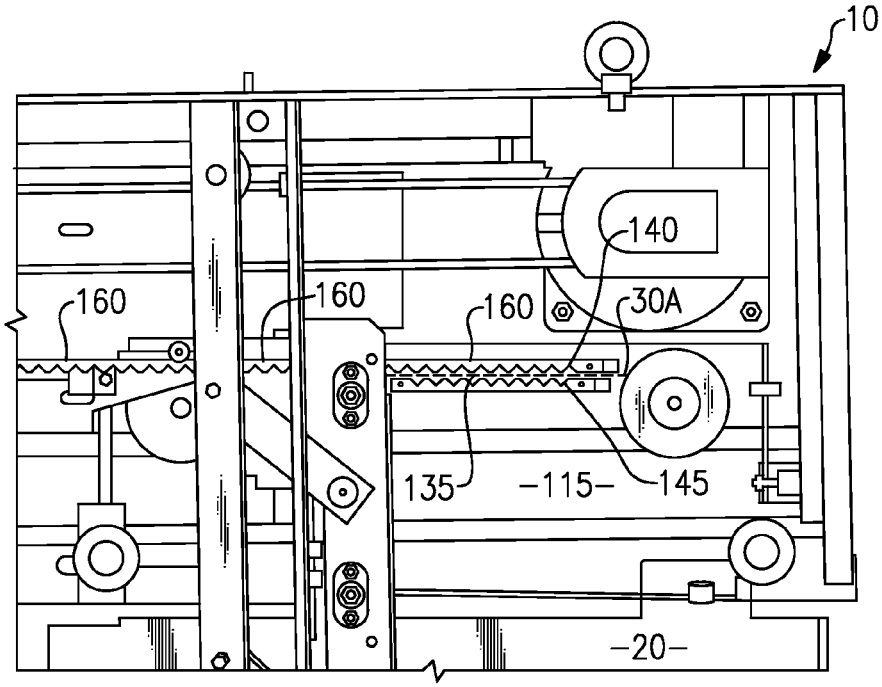
FIG. 10 is a depiction of the hanger and lintel of FIG. 7 shown in a fully open position.
Figure 11:
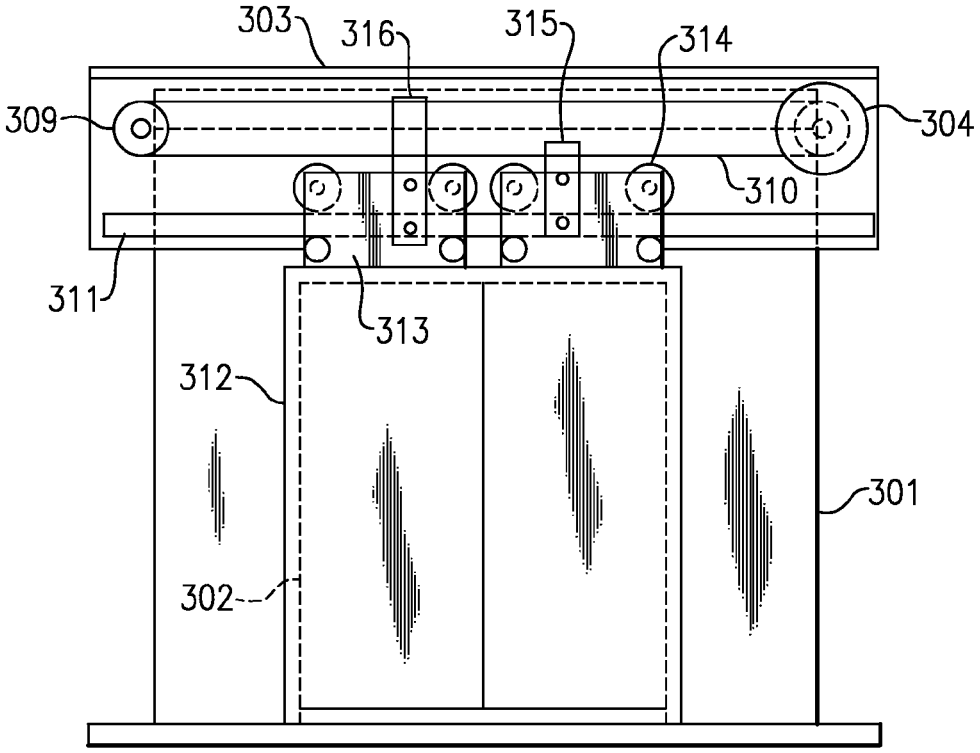
FIG.11 Prior Art
FIG. 11 is a schematic diagram showing a conventional car door opening and closing apparatus of an elevator.
Figure 12:
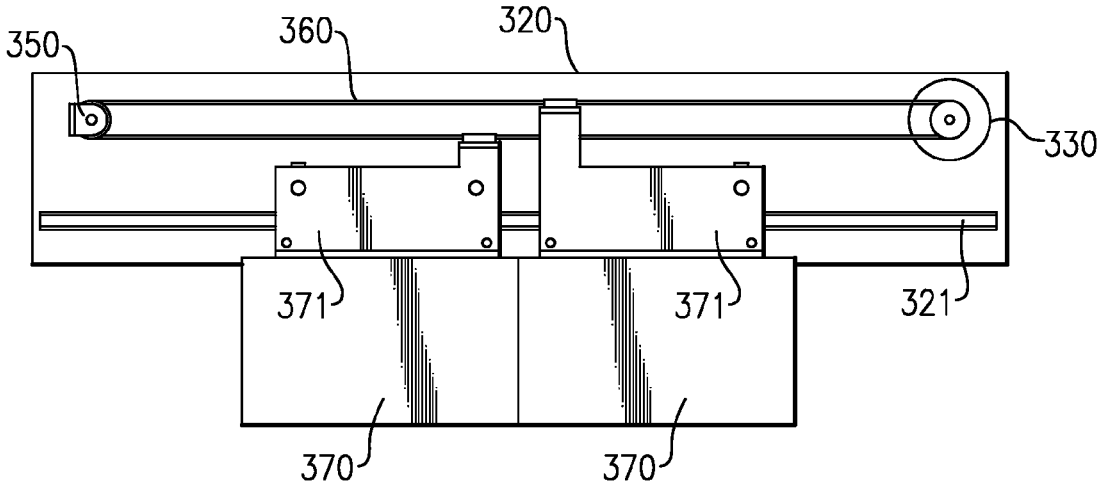
FIG. 12 is a schematic diagram showing the main parts of a car door opening and closing apparatus of an elevator of a third embodiment of the present invention.
Figure 13:
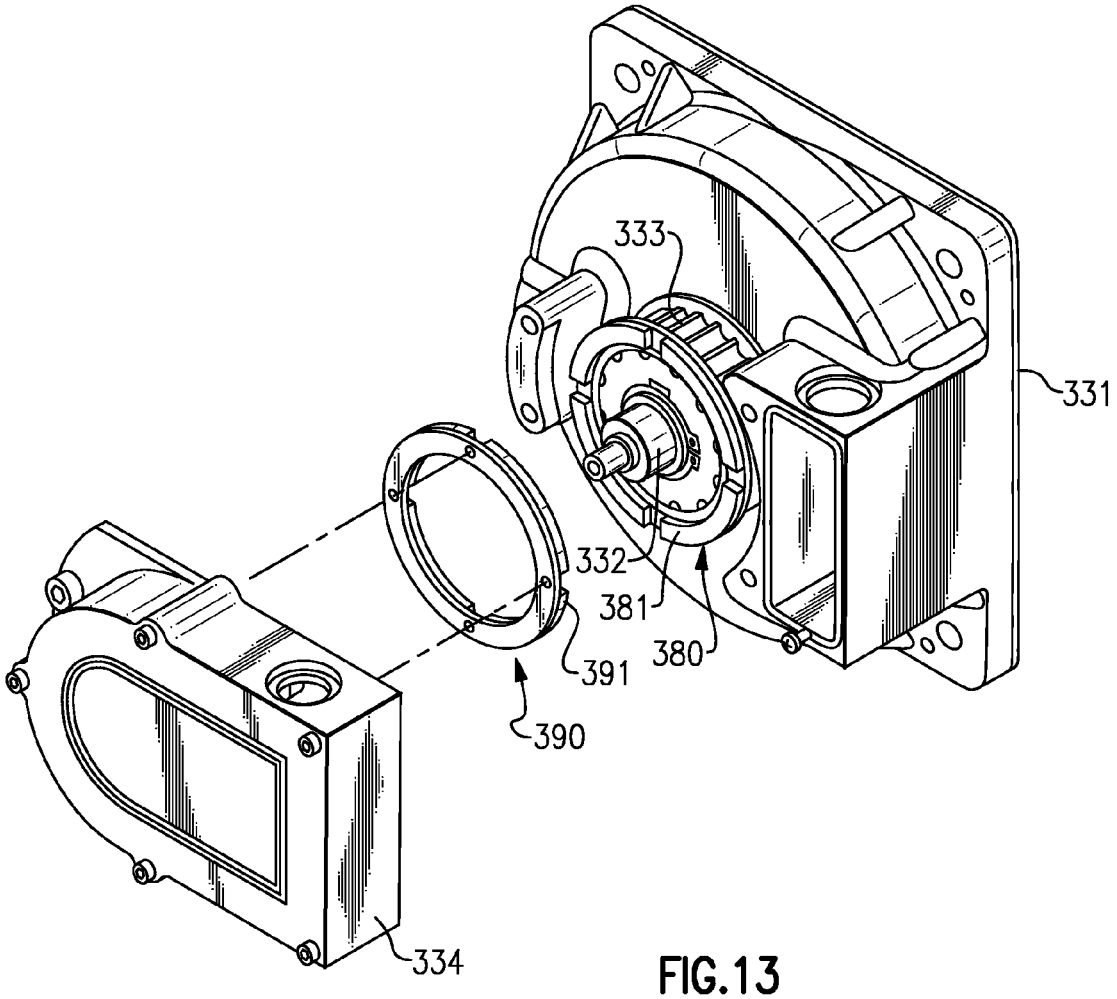
FIG. 13 is a disassembled oblique view showing the main parts of the third embodiment of the present invention.

Referring to FIG. 10, the door is shown fully open with the third array of magnets 135 held on the third holder 145 and the fourth array of magnets 140 held on the fourth holder 160 in register with each other. In such position, the repulsive force, as discussed supra, of the poles of third array of magnets 135 held on the third holder 145 and the like poles of the fourth array of magnets 140 held on the fourth holder 160 acts to minimize the likelihood of closure of the door panel 20, i.e., the fourth holder 160 inhibits closure of the door panel 20. Because the fourth array 140 extends along a length of the door opening, the magnets will cooperate to provide repulsive force at any point along door travel that may stop the car doors from closing should power be lost.

Figure 14:
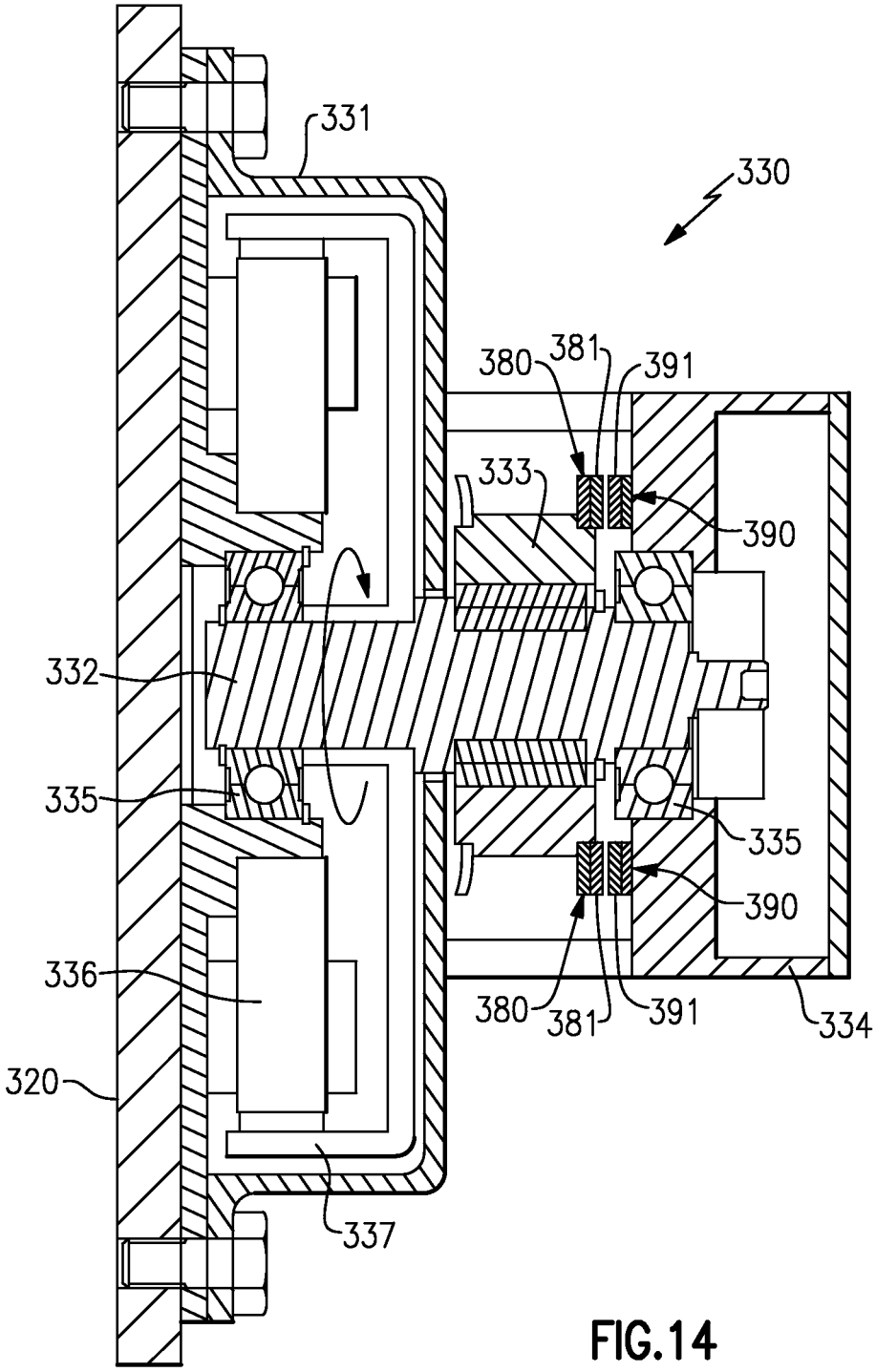
FIG. 14 is a cross section showing the main parts of the apparatus of the third embodiment of the present invention.

Two versions of a third embodiment of the present invention will now be discussed with reference to FIGS. 12-16. In the two versions of this embodiment, a motor 330 includes a rotational shaft 332, a stator 336, a rotor 337, and a pulley 333, which is coupled at an outer peripheral surface thereof to the shaft 332. The motor 330, which is fixedly installed at one end of a car door header 320, also includes a base 331 and housing 334 that covers the rotational shaft 332 and is fixedly coupled to base 331. A driven pulley 350 is installed at the opposite end of the header 320 and an endless belt 360 extends between the motor 330 and the driven pulley 350. Car doors 370, which are each respectively connected to the upper and lower sides of the belt 360, open and close in accordance with the forward and backward rotation of the belt 360. As shown in FIGS. 14, bearings 335 may be interposed among the rotational shaft 332, motor base 331, and motor housing 334 to facilitate rotation of the shaft 332 and the pulley 333.

In this third embodiment, which also includes a pair of magnet arrays to prevent (or at least inhibit) door closure if power to the motor 330 is lost, a fifth array of magnets 380 is disposed radially and fixedly on one side of the motor pulley 333, and a sixth array of magnets 390 is disposed radially and fixedly at an adjacent opposite side of the fifth array of magnets 380 on an inner side surface of the motor housing 334. Each of the magnets in the fifth array of magnets 380 has a polarity opposite that of a corresponding magnet in the sixth array of magnets 390 so that a mutual attraction is formed between the arrays of magnets 380, 390. As a result, when the rotational shaft 332 is stopped, for example when the power to the motor 330 is removed, the rotational shaft 332 is prevented (or at least inhibited) from being automatically rotated by the attraction between the fifth and sixth array of magnets 380, 390.

The fifth and sixth array of magnets 380, 390 respectively consist of several magnets 381, 391 each having an arc shape. Further, the magnets 381, 391 are separated at a fixed interval in the circular arc direction and form a circular shape.

Figure 15:
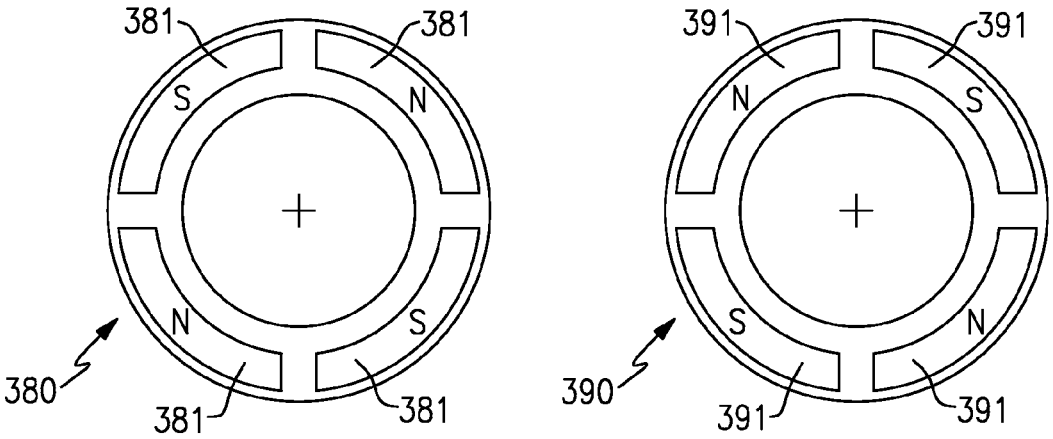
FIG. 15 is a schematic diagram showing first and second magnets of the third embodiment of the present invention.

In a first version of the third embodiment, which is shown in FIG. 15, several magnets 381, 391 of each of the fifth and sixth array of magnets 380, 390 are arranged with polarities different from each other along the circular arc direction. For example, several magnets 381, which form a circular shape of the fifth array of magnets 380, are arranged in order in a clockwise direction of n type→s type→n type→s type. The magnets 391 of the sixth array of magnets 390 are arranged in a clockwise direction of s type→n type→s type→n type. While the motor pulley 333 is forcedly rotated by the rotational shaft 332, since the turning force of the motor 330 is stronger than the attraction of the magnetic force between the magnets, the attraction is not dispositive. However, if the power to the motor 330 is cut off, the attraction that is generated between the magnets 381, 391 with polarities different from each other takes effect, thereby preventing (or at least inhibiting) the motor pulley 333 from rotation.

Figure 16:
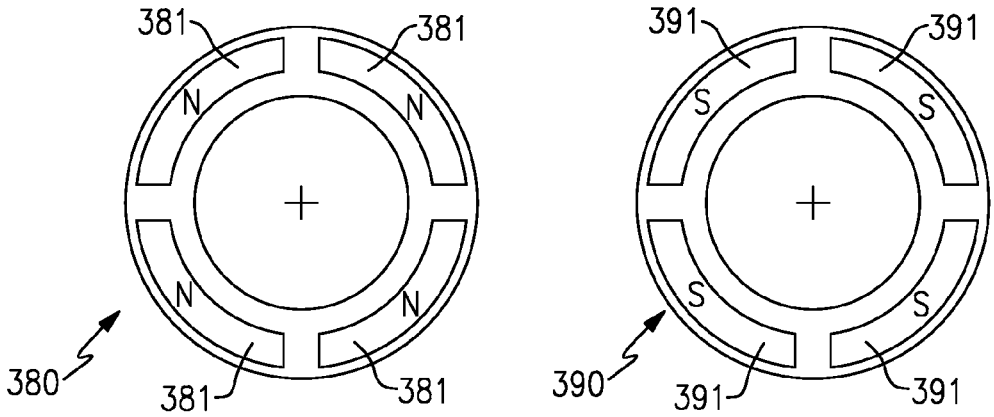
FIG. 16 is a schematic diagram showing first and second magnets of an alternate version of the third embodiment of the present invention.

In a second version of the third embodiment, which is shown in FIG. 16, several magnets 381, 391 of each of the fifth and sixth array of magnets 380, 390 have polarities relatively different from each other, though all the polarities are the same. In other words, all of magnets 381, which form a circular shape of the fifth array of magnets 380, are arranged in clockwise order of n type→n type→n type→n type, and all of the magnets 391 of the sixth array of magnets 390 are arranged in clockwise order of s type→s type→s type→s type. While the motor pulley 333 is forcedly rotated by the rotational shaft 332, since the turning force of the motor 330 is stronger than the attraction of the magnetic force between the magnets, the attraction is not dispositive. However, if the power to the motor 330 is cut off, the attraction between the magnets takes effect, preventing (or at least inhibiting) the motor pulley 333 from being automatically rotated.

Figure 17:
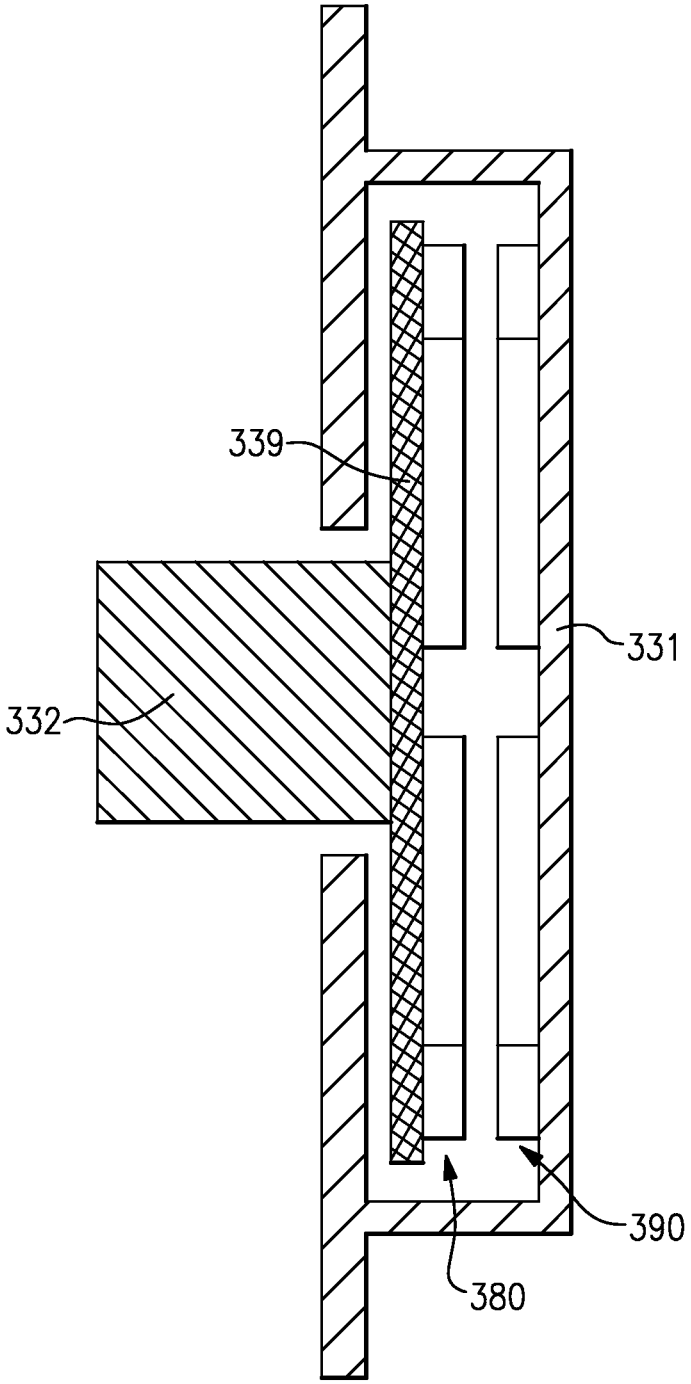
FIG. 17 is a schematic cross section showing another installation example of first and second magnets according to a fourth embodiment of the present invention.

In a fourth embodiment of the present invention, which is shown in FIG. 17, similar magnet arrays 380, 390 as were used in the third embodiment are employed. In this embodiment, however, the fifth array of magnets 380 is connected to a plate 339 provided at an end of the rotational shaft 332 whereas the sixth array of magnets 390 is arranged on the motor base 331 opposite the fifth array 380. Of course, either of the magnet arrangements used in the two versions of the third embodiment (shown in FIGS. 15 and 16) may be employed in this fourth embodiment.

The operation process of the apparatus for preventing (or at least inhibiting) closing of car doors of an elevator according to the third and fourth embodiments will hereafter be explained. First, the turning force of the rotational shaft 332 of the motor 330 is transmitted to the motor pulley 333 via the outer peripheral surface of the rotational shaft 332. As a result, the belt 360, which is wrapped around the outer peripheral surface of the motor pulley 333 and the driven pulley 350, is rotated forward and backward. Upper and lower sides of the belt's 360 endless loop are connected to the respective left and right car doors 370, thereby enabling the doors 370 to be mutually opened and closed by hangers 371 that slide or roll along the car door rail 321. As the motor pulley 333 is forcedly rotated by the rotational shaft 332, and as the turning force of the motor 330 is stronger than the attraction of the magnetic force between the fifth and sixth array of magnets 380, 390, the attraction is overcome by the force of the motor 330.

While the car doors 370 are opened and closed by the turning force of the motor 330 in this manner, if the power to the motor 330 is cut off, the rotation of the rotational shaft 332 and the motor pulley 333 is stopped. As a result of this stoppage, the attraction between the fifth and sixth array of magnets 380, 390 takes effect, thereby preventing (or at least inhibiting) the motor pulley 333 from rotating automatically in response to the otherwise natural closing action of the doors 370.

Though an attractive force is contemplated for use in the third and fourth embodiments, it should be understood that an arrangement of the fifth and sixth array of magnets 380, 390 is contemplated herein in which a repulsive force is utilized. For example, in another alternate version of the third embodiment, the fifth array or the sixth array may be disposed on pulley 333 and an inner side surface of the motor housing 334 so that the repulsive forces of the fifth and sixth array of magnets 380, 390 act to stop the rotational movement of the pulleys (similarly to the arrangement of the first array of magnets 35 and the second array of magnets 40).

Similarly it is contemplated that the first array of magnets 35 and the second array of magnets 40 may be ordered in polarity similarly to the arrangement of the fifth and sixth arrays of magnets 380, 390 so that an attractive, instead of a repulsive, force may prevent (or at least inhibit) movement of the doors 20. A difference between using attractive or repulsive magnetic forces is a question of phase which, given the number of magnets in each array, may not be significant.

Also, though the first array of magnets 35 and the second array of magnets 40 are arranged linearly and the fifth and sixth array of magnets 380, 390 are arranged non-linearly, other shapes may be used to take advantage of the attractive or repulsive forces of magnets to achieve the objective provided for herein. Moreover, it is contemplated herein that the fifth and sixth array of magnets 380, 390, may be placed on the driven pulley 350 and adjacent thereto on the header 320 by using the teachings provided herein.

The aforementioned discussion is intended to be merely illustrative of the present invention and should not be construed as limiting the appended claims to any particular embodiment or group of embodiments. Thus, while the present invention has been described in particular detail with reference to specific exemplary embodiments thereof, it should also be appreciated that numerous other modifications and/or changes may be made thereto without departing from the broader and intended scope of the invention as set forth in the claims that follow. For example, although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A device for inhibiting closing of an elevator car door that controls entry to an elevator car, said device comprising:

a powered mechanism for closing said door, a first magnet disposed on a driven portion of said door, and a second magnet disposed on a portion of said car, wherein said first magnet and said second magnet are permanent magnets, wherein said first magnet and said second magnet are configured to register with each other as said door moves toward a closed position, and wherein, if the first and second magnets are registered with each other, a pole of said first magnet is in close proximity of a pole of said second magnet such that said first magnet and said second magnet react to each other to inhibit motion of said door towards the closed position in a condition in which power for the powered mechanism is off.

2. The device of claim 1 wherein said first magnet is disposed in a first non-linear configuration on said driven portion.

3. The device of claim 2 wherein said second magnet is disposed in a second non-linear configuration on said fixed portion wherein said second non-liner configuration is in register with said first non-linear configuration.

4. The device of claim 2 wherein said driven portion comprises a pulley, said powered mechanism comprises a motor and wherein said pulley is driven by said motor.

5. The device of claim 4 wherein said motor is in a fixed position on said elevator car.

6. The device of claim 2 wherein said first non-linear configuration is arcuate.

7. The device of claim 1 wherein said first magnet is aligned at a first angle relative to an axis, said second magnet is aligned at a second angle relative to the axis, and wherein the axis passes between said door and said enclosure.

8. The device of claim 1 wherein said pole of said first magnet and said pole of said second magnet attract each other.

* * * * *